United States Patent [19]

Block

[11] Patent Number: 4,850,589

[45] Date of Patent: Jul. 25, 1989

[54] MULTIPLE STATION/MULTIPLE USER EXERCISING DEVICE

[76] Inventor: George E. Block, 7001 Culebra, San Antonio, Tex. 78238

[21] Appl. No.: 141,940

[22] Filed: Jan. 7, 1988

[51] Int. Cl.[4] ..... A63B 7/04; A63B 3/00

[52] U.S. Cl. ..... 272/113; 272/63; 272/112

[58] Field of Search ..... 272/112, 113, 93, 62, 272/63, 145, 144, 85, 109

[56] References Cited

U.S. PATENT DOCUMENTS

| | | | |
|---|---|---|---|
| 3,120,955 | 2/1964 | Carlin | 272/113 |
| 3,601,397 | 8/1971 | Carlin | 272/113 |
| 4,278,250 | 7/1981 | Baynes et al. | 272/112 |
| 4,682,772 | 7/1987 | Skalka | 272/113 |

*Primary Examiner*—S. R. Crow

*Attorney, Agent, or Firm*—David G. Henry

[57] ABSTRACT

A multiple station/multiple user exercise device having grasping sites for performing seated or kneeling chin-ups, situps, seated dips, and inclined pushups, the exercises necessary for overall physical fitness. The device is arranged so each site may be used by an individual concurrently with any other individual's use of another site, with as many as seven individuals using the device at any one time. The device is made from aluminum tubing and is inexpensive to manufacture and to transport. The device has no moving parts to injure users or to reduce its service expectancy. The preferred embodiment is sized for use by children near five feet, ten inches in height.

10 Claims, 2 Drawing Sheets

MULTIPLE STATION/MULTIPLE USER EXERCISING DEVICE

DESCRIPTION OF THE PREFERRED EMBODIMENT

1. Field of the Invention

This invention relates generally to the field of exercise devices for developing and strengthening various parts of the body. Specifically, the present invention provides a multiple use exercise apparatus on which a person or persons are able to perform a wide range of exercises to promote general fitness and work specific muscle groups.

2. Description of the Prior Art

The importance of regular exercise for building and maintaining strength and endurance cannot be over emphasized. The modern conveniences which we enjoy and the sedentary tasks which we perform have given us a comfortable lifestyle at the expense of physical fitness. This decline of physical fitness has been especially evident in American school children. According to a nation-wide survey conducted by the President's Council on Physical Fitness, the physical fitness of American public school children has shown virtually no improvement in the last ten years and, in some cases, has greatly deteriorated.

The survey shows that there are some major problems in physical fitness among the youth of this country. Many children are not getting the vigorous exercise they need to develop strong and healthy bodies. Poor physical fitness during a person's youth may have serious long-term medical consequences for an individual later on in life. Since children have special needs relating to their growth and development, professional planning of their exercise schedules and guidance in their performance is highly desirable. Many children who undertake planned exercise programs may be doing so for the first time and may be significantly under-conditioned. A very gradual and careful conditioning program should be used with such children.

It is well known to employ weights for muscle and general body building. For the trained athlete or comparatively physically fit, barbells and dumbbells are excellent equipment for weight-lifting exercises. For the inexperienced, however, this equipment is sometimes difficult and even dangerous to use. Furthermore, it is sometimes desirable but difficult to concentrate exercise on specific muscle groups with conventional weight lifting equipment. Because of the difficulty of balancing and/or the strain of holding barbells over the head, people are discouraged from using them or do not obtain the full benefits of arm exercise which should be derived. Sometimes, a barbell or dumbbell is dropped because of muscle fatigue, cramps, improper technique or because too much weight has been lifted, thereby causing injury to the user.

Further, the common practice in exercise machines is to employ a separate machine for each of the different parts of the body, such as the arms, the legs, the chest, and the shoulders. Thus, a person who is interested in developing or exercising more than one or two parts of the body must employ several different exercising machines. The use of several different machines is not only costly, but they also require a relatively large floor space. Both of these factors have made it impractical for most schools and virtually all individuals to have such equipment.

Even if the average child had access to the current exercising machines, the child would not be able to properly use the equipment. Most children are too weak or too small, according to the President's Council on Physical Fitness survey, to properly use the exercise machines on the market. Adult exercise machines have a number of dangerous moving parts, so even children who are of sufficient size and strength to use the machines must be closely supervised when using them. Supervision is difficult with such machines because of their large sizes which require that they be widely dispersed in any given area. It can, therefore, be seen that there would be great benefit from a device which would provide children the functions of several different exercise machines designed for children's special weight-lifting and strengthening needs, using a relatively small amount of floor space, and which would facilitate easy supervision of multiple children doing the exercises.

SUMMARY OF THE INVENTION

It is an object of the present invention to provide an exercise device with the assistance of which individuals may properly perform inclined pushups, seated or kneeling chin-ups, seated dips, leg lifts, and situps.

It is another object of the present invention to provide an exercise device which may be simultaneously used by two or more individuals.

It is another object of the present invention to provide an exercise device simultaneously usable by as many as seven individuals—four, in any combination, performing situps or leg lifts, one performing seated or kneeling chin-ups, one performing seated dips, and one performing inclined pushups.

It is another object of the present invention to provide an exercise device having means for assisting individuals in the performance of inclined pushups, seated dips, situps, leg lifts, and seated or kneeling chin-ups, which device is inexpensive to manufacture.

It is another object of the present invention to provide an exercise device having means for assisting individuals in the performance of inclined pushups, seated dips, situps, leg lifts, and seated or kneeling chin-ups, which device has no moving parts.

In accordance with the above objects, the present invention teaches a multiple station/multiple user exercising device comprising two tubular members which, when situated parallel and slightly displaced from each other, provide appropriately positioned attachment sites for a chin-up bar and an inclined pushup bar, and includes section usable as parallel bars. The station also includes bars appropriately situated for anchoring exerciser's feet during the performance of situps and hands during the performance of leg lifts. The exercise station of the preferred embodiment is constructed of lightweight and inexpensive aluminum tubing and has no moving parts.

DETAILED DESCRIPTION OF THE PREFERRED EMBODIMENT

Figure 1:
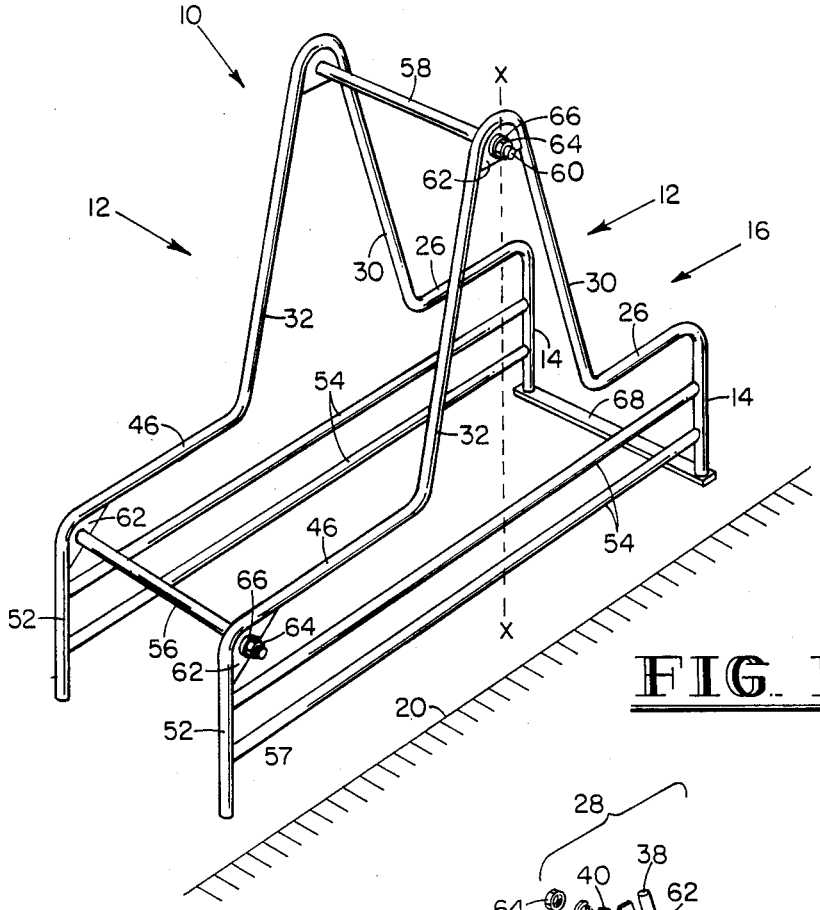
FIG. 1 is a perspective view of the preferred embodiment.

The present invention teaches a multiple station/multiple user exercising device. Referring to FIG. 1, the device is referred to generally by the reference numeral 10.

The device 10 satisfies the need for a single exercise device which provides grasping points for the human hand which are necessary for seated or kneeling chin-ups, seated dips, semi-inclined pushups and leg lifts, as well as sites where an exerciser's feet may be secured to aid in performing situps. The device 10 is arranged such that use of one of the "sites" by one person does not interfere with the use of any other site by another person and vice versa. The device 10 is lightweight, easily assembled, disassembled and stored, and is inexpensive to manufacture and ship.

The fact that the device 10 facilitates very thorough physical fitness program taken with its cost effectiveness makes the device 10 ideal for placement in schools, day care centers, sports clubs, church playgrounds, summer camps, and any other facility where the physical fitness of a large number of children must be tended to in a most cost efficient manner.

Figure 2:
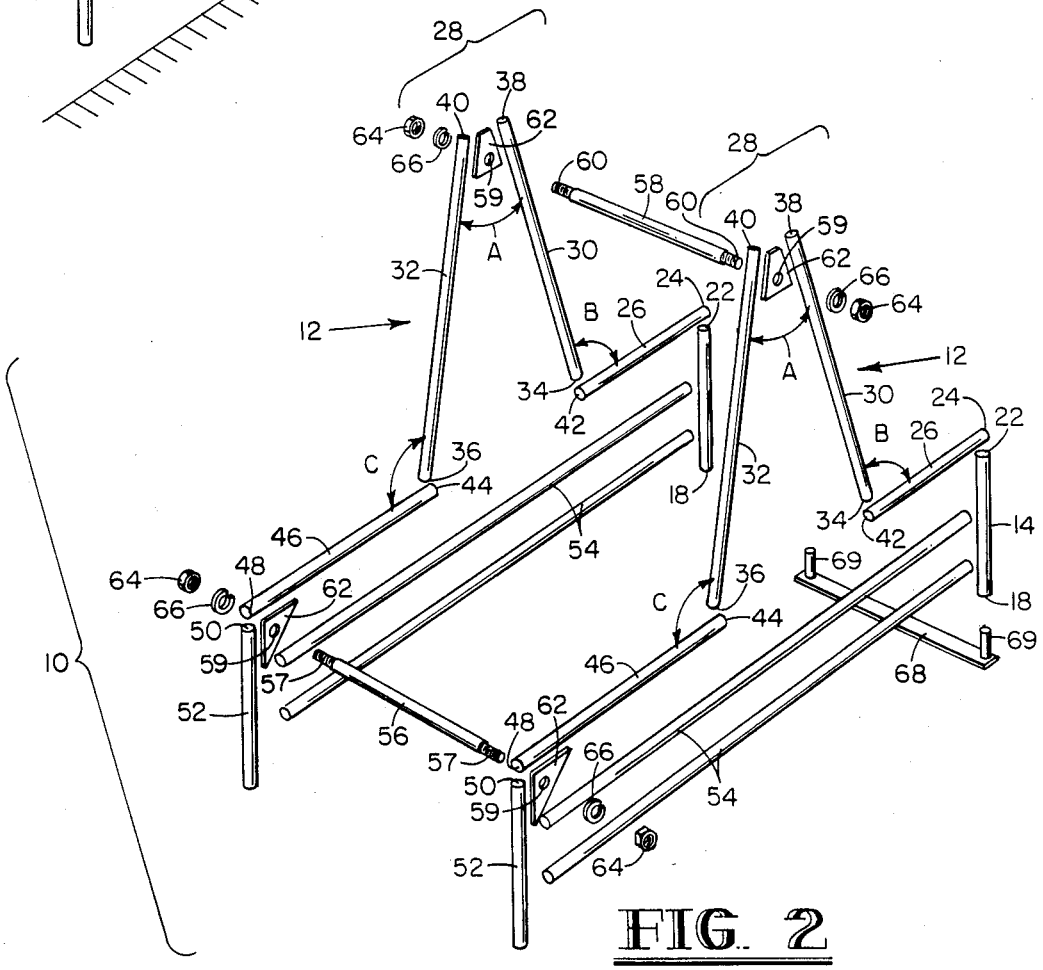
FIG. 2 is an exploded perspective of an alternative embodiment of the exercise device which is composed of a plurality of tubular segments.

Referring to FIGS. 1 and 2, the greater portion of the device 10 comprises two side members 12 which, in the preferred embodiment, are made from aluminum tubing having a one inch exterior diameter and a $\frac{7}{8}$ths inch interior diameter. Other materials in tubular form such as fiberglass, polyvinyl chloride, or graphite may form the tubular material provided that they are used in thicknesses having sufficient strength to sustain the weight of individuals using the device 10 as hereinafter described. Although the side members 12 of the preferred embodiment are single pieces of tubing which are bent or otherwise formed to have the necessary shape shown in FIG. 1, the operative portions of the side members 12 will be identified and discussed as separate components (as shown in FIG. 2) for ease of understanding. Of course, alternative embodiments may include side members 12 made from separate segments of tubing which may be joined together by welding.

Each side member 12 has a first leg section 14 at its first end 16. The first leg section 14 is approximately 15 inches in length and has a terminal end 18 which rests on the ground 20 either directly or through a brace member (to be discussed hereinafter), and an interior end 22. The interior end 22 of the first leg section 14 is joined with a distal end 24 of a first parallel bar section 26. The first leg section 14 and the first parallel bar section 26 are joined such that they form sides of a right angle. Therefore, when the first leg section 14 is vertically oriented relative to the ground (which it will be in use) the first parallel bar section 26 will be horizontally oriented. The first parallel bar is approximately 20 inches in length.

The side members 12 include a caret-shaped chin-up bar support member 28. The caret-shaped member 28 comprises first and second arms 30 and 32 each having a base end 34 and 36 respectively and an apex end 38 and 40 respectively. The arms 30 and 32 are approximately 32 inches in length. The apex ends 38 and 40 are joined such that the arms 30 and 32 form an approximately 30 degree angle "A" with respect to each other. The base end 34 of the first arm 30 is joined with the medial end 42 of the first parallel bar section 26 to form an angle "B" of approximately 105 degrees. The base end 36 of the second arm 32 is joined with a proximal end 44 of a second parallel bar 46. The second arm 32 and the second parallel bar 46 are joined to form approximately a 105 degree angle "C". The second parallel bar 46 is approximately 20 inches in length.

The arms 30 and 32 are thus oriented relative to the remaining parts of the device 10 such that an imaginary line "X" bisecting angle "A" will be parallel to the first leg section 14 and the second leg section (not yet identified).

The distal end 48 of the second parallel bar 46 joins the interior end 50 of the second leg section 52 forming a 90 degree angle. In this configuration, the first leg section 14 and the second leg section 52 are parallel to each other and longitudinally identically situated. As previously mentioned, the above-referenced components of the side members 12 are, in the preferred embodiment, actually portions of a continuous section of metallic tube which is bent to form the necessary components.

Referring again to FIGS. 1 and 2, each of the side members 12 further comprise two situp/leg lift bars 54 which extend between the first leg section 14 and the second leg section 52. The situp/leg lift bars 54 serve as foot stops for use by persons performing situps, handholds for providing stability for persons performing leg lifts, and also serve to maintain the side members 12 in their intended configuration.

The two side members 12 of the preferred embodiment are joined together at three points. The means for joining the side members 12 at two of these three points are themselves functional parts of the exercise device 10 aside from their service as connecting members. The first of these connecting members is an inclined pushup bar 56. The inclined pushup bar 56 is approximately 24 inches in length. The ends 57 of the inclined pushup bar 56 are respectively attached to the two side members 12 at the juncture between their second leg section 52 and the second parallel bar 46. The inclined pushup bar 56 connected to the side members 12 in this manner, serves as a grasping point approximately 15 inches from the ground 20 which a person may use to do inclined pushups. The length of the inclined pushup bar 56 dictates the separation of the side members 12 which separation is important for reasons to be discussed hereinafter.

The second of the multi-functional connecting members is a chin-up bar 58. Because the side members 12 are in the completed exercise device 10 parallel along their entire length, the chin-up bar 58 of the preferred embodiment is of the same length as the inclined pushup bar 56 (24 inches). The ends 60 of the chin-up bar 58 are respectively attached to the two side members 12 at the juncture of the apex ends 38 and 40 of the arms 30 and 32. Because of the length and orientation of the arms 30 and 32 and the attachment point of the chin-up bar 58, the chin-up bar 58 is approximately 45 inches from the surface of the ground 20.

Corner plates 62 are used in the preferred embodiment to attach the ends 58 of the inclined pushup bar 56 and the ends 60 of the chin-up bar 58 to their respective attachment points on the side members 12. This arrangement provides a greater degree of stability as the bars 56 and 58 are thereby effectively attached to the tubing material over a greater portion of its length.

So that the exercise device 10 may be easily and assembled and disassembled for transportation, the ends 57 of the inclined pushup bar 56 and the ends 60 of the chin-up bar 58 are threaded and are held in place through holes 59 in each of the corner plates 62 by removable nuts 64 which in turn are secured by locking washers 66. Alternatively, threads (not shown) may be formed surrounding the holes 59 in each of the corner plates 62, the threads surrounding each hole 59 opposing each other on either side member 12 being appropriately directed so that the respective bar 56 or 58 could simply be rotated in a first direction and thereby be simultaneously threaded into appropriate holes 59 of each side member 12.

The third connecting member is a brace 68 which merely serves to maintain the side members 12 in their proper respective positions at the first end 16 and thereby stabilize the overall exercising device 10. The brace 68 is a flattened metal bar to which the terminal end 18 of the first leg section 14 of each side member 12 is attached. The attachment is by means of two rods 69, one at either end of the brace 68, which telescopically extend into the first leg sections 14 and thereby effectively join the brace 68 with the side members 12.

Figure 3:
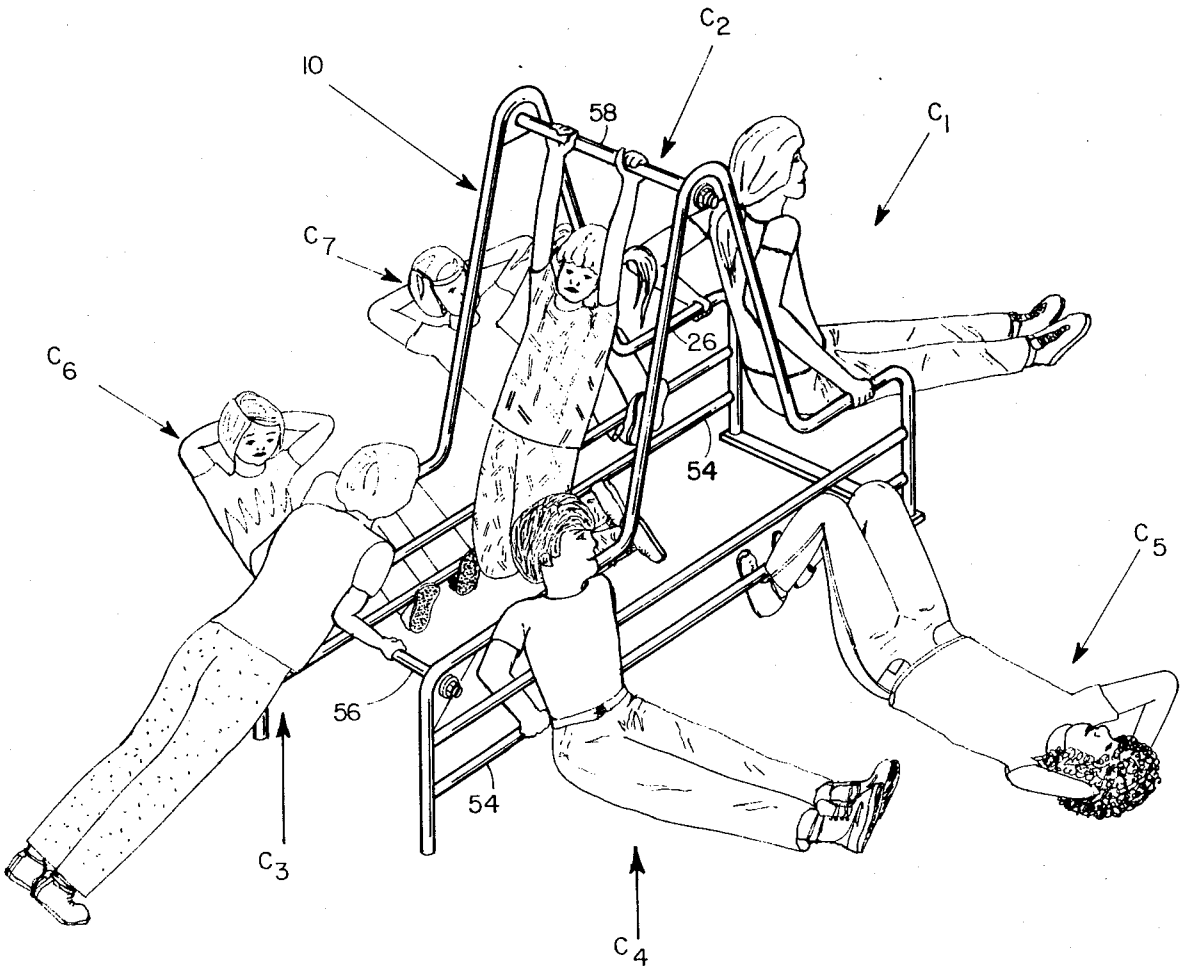
FIG. 3 is a perspective view of the preferred embodiment showing seven children using the device.

Referring to FIG. 3, the exercise device 10 as described above may be simultaneously used by as many as seven children. One child $C_1$ may be performing seated dips on the first parallel bars 26, a second child $C_2$ may be performing seated or kneeling chin-ups on the chin-up bar 58, a third child $C_3$ may be performing inclined pushups at the inclined pushup bar 56, and four additional children $C_4$, $C_5$, $C_6$, and $C_7$ may be performing situps or leg lifts (in any combination) using the situp/leg lift bars 54 to respectively anchor their feet or their hands.

The use of the first parallel bars 26 for performing seated dips is the primary basis for the side member's 12 being approximately 24 inches apart. Because the exercise device 10 is designed primarily for use by children, a separation of approximately 24 inches has been determined to be most appropriate. It is noted that simple enlargement or contraction of the dimensions stated herein would make the device 10 respectively suitable for adults or younger children as well.

The length of the parallel bars 26 and 46 as well as the length and orientation of the arms 30 and 32 of the caret-shaped member 28 are also relevant to the intended use of the exercise device 10. The length of the first parallel bars 26 being approximately 20 inches insures that a child performing seated or kneeling chin-ups at the chin-up bar 58 will not interfere with a child doing seated dips on the first parallel bar section 26 at the device's first end 16 and vice versa. Likewise, the length of the second parallel bar 46 insures that there will be no interference between the child performing seated or kneeling chin-ups and the child performing inclined pushups at the device's second end 17. Finally, the length and orientation of the arms 30 and 32 result in the chin-up bar 58 being approximately 45 inches from the ground. This height is considered an appropriate height from which children can perform seated or kneeling chin-ups, otherwise known as reduced percentage of body weight chin-ups. The exercise device 10 provides the opportunity for persons to perform four of the five "must-do" exercises for general physical fitness. Pushups most notably serve to condition the: pectoralis major, anterior deltoid, pectoralis minor, and triceps. The chin-up serves to condition the: pectoralis major, latissimus dorsi, posterior deltoid, trapezius 3 and 4, biceps, brachialis, and various muscles in the wrists. The situp conditions the: rectus abdominis, oblique abdominals, thoracic and lumbar portions of the spinal extensors, iliopsoas, and the rectus femoris. Finally, the dip most notably conditions the triceps, deltoids, pectoralis major, and pectoralis minor.

When pushups, seated or kneeling chin-ups, situps and seated dips are combined with an exercise such as the squat jump for conditioning the leg muscles, for which exercise no exercise device is necessary, all major muscle groups of the body will have been worked. It is noted that while many would consider the pushup to be an exercise not requiring an exercise device, many individuals are simply not strong enough to perform the traditional floor based pushup. An inclined pushup is somewhat easier to perform, and an inclined pushup wherein the exerciser may firmly grip that which he or she pushes from is quite safe. Therefore, the inclined pushup bar 56 of the device 10 has definite utilitarian advantages.

Augmenting the utilitarian advantages of the device 10 which have already been discussed, the device 10 has the advantageous feature of lacking moving parts. Moving parts such as pulleys, gears, springs, and moving weights which are typical of many exercise devices often make such devices unsafe for use by children. The lack of moving parts not only makes the device 10 safer, but also gives it an essentially indefinite service expectancy.

In summary, the present invention teaches an exercise device having the following benefits: (1) the device facilitates each of the basic exercises which are recommended for achieving a general state of physical fitness and which, for proper performance by a beginning exerciser, require the assistance of an exercise device; (2) the device may be simultaneously used by as many as seven individuals with minimal supervision and space requirements; (3) the device is inexpensive to manufacture, to ship, and to install; (4) because of a total lack of moving of parts, the device is very safe and has an indefinite service expectancy.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A multi-station exercise device providing appropriate grasping sites for situps, leg lifts, seated or kneeling chinups, seated dips and inclined pushups and being arranged for simultaneous use by a plurality of persons comprising:

first and second side members;

a chin-up bar; and an inclined pushup bar;

said first and second side members each having a first leg section with a first ground engaging terminal end and a first interior end, a first parallel bar section with a first proximal end and a first distal end, a first chin-up bar support member arm with a first base end and a first apex end, a second chin-up bar support member arm having a second apex end and a second base end, a second parallel bar section with a second proximal end and a second distal end, and a second leg section having a second interior end and a second base end;

said first interior end of said first leg section being attached to said first distal end of said first parallel bar section whereby said first leg section and said first parallel bar section arms of a 90 degree angle;

said first proximal end of said first parallel bar section being attached to said first base end of said first chin-up bar support member arm whereby said first parallel bar section and said first chin-up bar support member form sides of a 105 degree angle lying in the same vertical plane as defined by said first parallel bar section and said first leg section and whereby said apex ends are disposed above the parallel bar sections relative to the ground;

said first apex end of said first chin-up bar support member arm being attached to said second apex end of said second chin-up bar support member arm whereby said first and second arms form sides of an approximately 30 degree angle residing in said plane;

said second base end of said second chin-up support member arm being attached to said second proximal end of said second parallel bar section whereby said second arm and said second parallel bar section form sides of an approximately 105 degree angle lying in said plane and whereby said second parallel bar section extends in the opposite direction of said first parallel bar section;

said second distal end of said second parallel bar section being attached to said second interior end of said second leg section whereby said second parallel bar section and said second leg section form an approximately 90 degree angle lying in said plane and whereby said second terminal end of said second leg section and said first terminal end of said first leg section reside in substantially the same second plane;

said chin-up bar having first and second ends being attached respectively to said first and second side members at the point of attachment between said first and second apex ends of said first and second chin-up bar support member arms;

said inclined pushup bar having first and second pushup bar ends being attached respectively to said first and second side members at the point of attachment between said second distal ends of said second parallel bar sections and second interior ends of said second leg sections;

said chin-up bar and said inclined pushup bar having a length whereby an individual may perform seated or kneeling chin-ups on said chin-up bar between said first and second side members and whereby said individual may perform seated dips on said first parallel bar sections said first and second side members;

said first and second side members each further comprising a situp/leg lift bar of anchoring the feet of an exerciser performing sit ups and for providing hand grasping sites for stabilizing persons performing leg lifts, said situp/leg lift bar of each said side member having first and second situp/leg lift bar ends respectively attached to said first and second leg sections at a point approximately 6 inches from said first and second terminal ends respectively.

2. The invention of claim 1 where n said first and second leg sections are approximately 15 inches in length, said first and second parallel bar sections are approximately 20 inches in length, said first and second chin-up bar support member arms are approximately 32 inches in length and said chin-up bar and said inclined pushup bar are approximately 24 inches in length.

3. The invention of claim 2 where n said first and second leg sections, said first and second parallel bar sections said first and second chin-up bar support member arms, said chin-up bar, and said inclined pushup bar are made of aluminum tubing having an external diameter of approximately 1 inch an internal diameter of approximately $\frac{7}{8}$ of an inch.

4. The invention of claim 3 wherein said first and second leg sections, said first and second parallel bar sections said first and second chin-up bar support member arms, said chin-up bar, and said inclined pushup bar of each said side member are portions of a continuous piece of aluminum tubing bent to form said sections.

5. The invention of claim 1 wherein said first and second inclined pushup bar ends and said first and second chin-up bar ends are threaded and further comprising:

two first triangle shaped metal plates one respectively attached to said second arm section and to said second parallel bar section of each of said side members, each said first plate having a pushup bar hole therethrough sized and shaped for receiving said first and second inclined pushup bar ends;

two second triangle shaped metal plates one respectively attached to said first chin-up bar support member arm and to said second chin-up bar support member arm of each of said side members, each said second plate having a chin-up bar hole therethrough sized and shaped for receiving said first and second chin-up bar ends;

first and second chin-up bar nuts sized for threaded engagement with said first and second chin-up bar ends;

first and second inclined push-up bar nuts sized for threaded engagement with said first and second push up bar ends;

first and second chin-up bar lock washers sized for placement on said first and second chin-up bar ends; and first and second inclined push-up bar lock washers sized for placement on said first and second push-up bar ends;

said threaded ends, nuts, and lock washers for permitting said device to be repeatedly assembled and disassembled without destruction or damage to said device.

6. The invention of claim 1 further comprising:

two first triangle shaped metal plates one respectively attached to said second arm section and to said second parallel bar section of each of said side members, each said first plate having a pushup bar hole therethrough sized and shaped for receiving said first and second inclined push-up bar ends;

two second triangle shaped metal plates one respectively attached to said first chin-up bar support member arm and to said second chin-up bar support member arm of each of said side members, each said second plate having a chin-up bar hole therethrough sized and shaped for receiving said first and second chin-up bar ends, wherein said pushup bar holes and said chin-up bar holes are surrounded by threads formed in said first and said second triangle shaped plates whereby said inclined pushup bar and said chin-up bar may be attached to said side members without nuts.

7. A multi-station exercise device providing appropriate grasping sites for situps, leg lifts, seated or kneeling chin-ups, seated dips and inclined-pushups and being arranged for simultaneous use by a plurality of persons comprising:

first and second side members;

a chin-up bar; and an inclined pushup bar;

said first and second side members each having a first leg section with a first ground engaging terminal end and a first interior end, a first parallel bar section with a first proximal end and a first distal end, a first chin-up bar support member arm with a first base end and a first apex end, a second chin-up bar support member arm having a second apex end and a second base end, a second parallel bar section with a second proximal end and a second distal end, and a second leg section having a second interior end and a second base end;

said first interior end of said first leg section being attached to said first distal end of said first parallel bar section whereby said first leg section and said first parallel bar sections form arms of a 90 degree angle; said first proximal end of said first parallel bar section being attached to said first base end of said first chin-up bar support member arm whereby said first parallel bar section and said first chin-up bar support member are form sides of a 105 degree angle lying in the same vertical plane as defined by said first parallel bar section and said first leg section and whereby said apex ends are disposed above the parallel bar sections relative to the ground;

said first apex end of said first chin-up bar support member arm being attached to said second apex end of said second chin-up bar support member arm whereby said first and second arms form sides of an approximately 30 degree angle residing in said plane;

said second base end of said second chin-up support member arm being attached to said second proximal end of said second parallel bar section whereby said second arm and said second parallel bar section form sides of an approximately 105 degree angle lying in said plane and whereby said second parallel bar section extends in the opposite direction of said first parallel bar section;

said second distal end of said second parallel bar section being attached to said second interior end of said second leg section whereby said second parallel bar section and said second leg section form an approximately 90 degree angle lying in said plane and whereby said second terminal end of said second leg section and said first terminal end of said first leg section reside in substantially the same second plane;

said chin-up bar having first and second ends being attached respectively to said first and second side members at the point of attachment between said first and second apex ends of said first and second chin-up bar support member arms;

said inclined pushup bar having first and second pushup bar ends being attached respectively to said first and second side members at the point of attachment between said second distal ends of said second parallel bar sections and second interior ends of said second leg sections;

said chin-up bar and said inclined pushup bar having a length whereby an individual may perform seated or kneeling chin-ups on said chin-up bar between said first and second side members and whereby said individual may perform seated dips on said first parallel bar sections between said first and second side members;

said first and second side members each further comprising a situp/leg lift bar for anchoring the feet of an exerciser performing situps and for providing hand grasping sites for stabilizing persons performing leg lifts, said situp/leg lift bar of each said side member having first and second situp/leg lift bar ends respectively attached to said first and second leg sections at a point approximately 6 inches from said first and second terminal ends respectively;

said first and second leg sections being approximately, 15 inches in length, said first and second parallel bar sections being approximately 20 inches in length, said first and second chin-up bar support member arms being approximately 32 inches in length, and said chin-up bar and said inclined pushup bar being approximately 24 inches in length;

said first and second leg sections, said first and second parallel bar sections said first and second chin-up bar support member arms, said chin-up bar, and said inclined pushup bar being made of aluminum tubing having an external diameter of approximately 1 inch an internal diameter of approximately $\frac{7}{8}$ of an inch;

two first triangle shaped plates one respectively attached to said second arm section and to said second parallel bar section of each of said side members, each said first plate having a hole therethrough sized and shaped for receiving said first and second inclined pushup bar ends;

two second triangle shaped plates one respectively attached to said first chin-up bar support member arm and to said second chin-up bar support member arm of each of said side members, each said second plate having a hole therethrough sized and shaped for receiving said first and second chin-up bar ends;

first and second chin-up bar nuts sized for threaded engagement with said first and second chin-up bar ends;

first and second inclined push-up bar nuts sized for threaded engagement with said first and second pushup bar ends;

first and second chin-up bar lock washers sized for placement on said first and second chin-up bar ends; and first and second inclined push-up bar lock washers sized for placement on said first and second push-up bar ends;

said threaded ends, nuts, and lock washers for permitting said device to be repeatedly assembled and disassembled without destruction or damage to said device.

8. A multi-station exercise device providing appropriate grasping sites for sit-ups, leg lifts, seated or kneeling chin-ups, seated dips, and inclined push-ups and being arranged for simultaneous use by a plurality of persons comprising:

first and second side members of substantially identical size and shape formed from tubular segments and being situated parallel with each other and displaced from each other by approximately twenty four inches along their lengths;

each said side member having first and second leg segments situated respectively at first and second ends of said side members, said leg segments each having a ground engaging terminal end and an interior end in a same first plane with said first and second leg segments being oriented parallel with each other, said leg segments being approximately 15 inches in length, said side members also having first and second parallel bar segments approximately 20 inches in length, each having distal and proximal ends, said distal ends respectively joining said interior ends of said first and second leg segments at a right angle, said parallel bar segments lying substantially in a same second plane with each other, said side members each further having a caret shaped member intervening said first and second parallel bar segments, said caret shaped member having first and second arms of approximately 32 inches in length, each having an apex end and a base end, said apex ends being joined whereby said arms form sides of an approximate 30 degree angle, said base ends of said first and second arms being respectively joined with said proximal ends of said first and second parallel bar segments whereby said apex ends are above the parallel bar segments relative to the ground, said arms and said parallel bar segments form sides of an approximately 105 degree angle, and said arms reside in said first plane;

a chin-up bar having first and second chin-up bar ends and extending between said side members and joined at said first and second chin-up bar ends with said side members respectively on each said side member at a point where said apex ends of said arms of said caret shaped portion are joined;

a push-up bar having first and second push-up bar ends and extending between said side members and joined at said first and second push-up bar ends with said side members respectively on each said side member at a point where, said distal end of said first parallel bar segment joins with said interior end of said first leg segment; and first and second situp/leg lift bars extending between and attached to said first and second leg segments of each of said side members, said situp/leg lift bars being positioned parallel with and approximately 6 and 12 inches from said surface respectively.

9. The invention of claim 1 wherein said first and second leg segments, said first and second parallel bar segments, and said arms of said caret shaped member of said first and second side members are portions of singular tubular members bent to form said leg segments, parallel bar segments, and arms.

10. The invention of claim 2 wherein said tubular members are aluminum, have an outer diameter of one inch, and have a thickness whereby said tubular members have an interior diameter of $\frac{7}{8}$th's of an inch.

* * * * *